US010364779B2

(12) United States Patent
Ohta et al.

(10) Patent No.: US 10,364,779 B2
(45) Date of Patent: Jul. 30, 2019

(54) AIR CLEANER FOR INTERNAL COMBUSTION ENGINE

(71) Applicant: MAHLE FILTER SYSTEMS JAPAN CORPORATION, Tokyo (JP)

(72) Inventors: Katsuhisa Ohta, Kawagoe (JP); Yuichi Kato, Fujimino (JP); Takafumi Shibata, Kawagoe (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 0 days.

(21) Appl. No.: 15/807,008

(22) Filed: Nov. 8, 2017

(65) Prior Publication Data

US 2018/0128218 A1 May 10, 2018

(30) Foreign Application Priority Data

Nov. 10, 2016 (JP) ..... 2016-219299

(51) Int. Cl.

| | |
|---|---|
| ***F02M 35/10*** | (2006.01) |
| ***F02M 35/14*** | (2006.01) |
| ***F02M 35/02*** | (2006.01) |
| ***F02M 35/12*** | (2006.01) |
| ***F02M 35/024*** | (2006.01) |

(52) U.S. Cl.

CPC ..... *F02M 35/14* (2013.01); *F02M 35/0202* (2013.01); *F02M 35/024* (2013.01); *F02M 35/1222* (2013.01); *F02M 35/1233* (2013.01); *F02M 35/1238* (2013.01); *F02M 35/1261* (2013.01); *F02M 35/1277* (2013.01); *F02M 35/02491* (2013.01)

(58) Field of Classification Search

CPC ..... F02M 35/14; F02M 35/1255; F02M 35/1261; F02M 35/1222; F02M 35/02491

USPC ..... 123/184.21

See application file for complete search history.

(56) References Cited

U.S. PATENT DOCUMENTS 3,990,415 A * 11/1976 Malphettes ..... F02M 35/14 123/184.57

4,713,097 A * 12/1987 Grawi ..... F02M 35/14 123/198 E (Continued)

FOREIGN PATENT DOCUMENTS

EP 0 649 982 A1 4/1995

EP 0 896 148 A2 2/1999

(Continued)

OTHER PUBLICATIONS

Extended European Search Report, dated Apr. 19, 2018, 7 pages.

European Office Action, dated Oct. 31, 2018, 4 pages.

European Office Action, dated Apr. 9, 2019, 3 pages.

*Primary Examiner* — Marguerite J McMahon

*Assistant Examiner* — James J Kim

(74) *Attorney, Agent, or Firm* — Foley & Lardner LLP

(57) ABSTRACT

An air cleaner for an internal combustion engine is arranged to reduce intake noise. The air cleaner includes an air cleaner element for cleaning an intake air, and an elastic member for reducing intake noise by utilizing an inside space of the air cleaner. An inside space of the elastic member is in communication with the inside space of the air cleaner through a communication passage. Preferably, a surrounding space formed between the elastic member and a case portion for receiving the elastic member is opened to the outside.

11 Claims, 6 Drawing Sheets

(56) References Cited

U.S. PATENT DOCUMENTS

| | | | | |
|---|---|---|---|---|
| 5,865,863 | A * | 2/1999 | DeSousa | F02M 35/0203 123/198 E |
| 6,698,390 | B1 * | 3/2004 | Kostun | F02M 35/1222 123/184.57 |
| 6,783,579 | B2 * | 8/2004 | Pettipiece | B01D 46/10 123/184.57 |
| 7,143,736 | B2 * | 12/2006 | Jessberger | B62D 21/16 123/198 E |
| 2005/0279319 | A1 * | 12/2005 | Jessberger | B62D 21/16 123/198 E |
| 2006/0027204 | A1 * | 2/2006 | Vogt | F02M 35/266 123/184.57 |
| 2006/0065479 | A1 * | 3/2006 | Okawa | F02M 35/1266 181/250 |
| 2007/0131189 | A1 | 6/2007 | Shinada et al. | |
| 2009/0008181 | A1 | 1/2009 | Pedersen et al. | |
| 2009/0236171 | A1 * | 9/2009 | Yokoya | F02M 35/10295 181/160 |
| 2009/0293832 | A1 * | 12/2009 | Matsumoto | F02M 35/1238 123/184.61 |
| 2013/0291500 | A1 * | 11/2013 | Rodabaugh | F02M 35/1216 55/462 |
| 2014/0260132 | A1 * | 9/2014 | Maruyama | B01D 46/0041 55/418 |
| 2016/0230719 | A1 * | 8/2016 | Kato | F02M 35/1261 |
| 2017/0175690 | A1 * | 6/2017 | Ohta | F02M 35/1266 |

FOREIGN PATENT DOCUMENTS

| | | | |
|---|---|---|---|
| EP | 1111 228 | A2 | 6/2001 |
| EP | 3 056 723 | A1 | 8/2016 |
| FR | 3002595 | A1 | 8/2014 |
| GB | 1 315 163 | A | 4/1973 |
| JP | 2013-124599 | A | 6/2013 |
| WO | WO-2013/089010 | A1 | 6/2013 |

* cited by examiner

AIR CLEANER FOR INTERNAL COMBUSTION ENGINE

BACKGROUND OF THE INVENTION

The present invention relates to an air cleaner for an internal combustion engine, and more specifically to an air cleaner in an intake system including an intake noise reducing device using a bellows-shaped elastic member.

JP 2013-124599A shows an intake noise reducing device for an internal combustion engine, of a novel type proposed by the assignee of the present application. This intake noise reducing device has a construction including an elastically deformable bellows-shaped elastic member defining a volume chamber and a communication pipe serving as a neck tube of a Helmholtz resonator and connecting the volume chamber with an intake passage of the internal combustion engine. This elastic member is received in a cylindrical case opened to the atmosphere.

SUMMARY OF THE INVENTION

In the intake noise reducing device of the above-mentioned patent document, the bellows-shaped elastic member is connected to the side of the intake passage in the form of a branch passage. Therefore, the intake noise reducing device projecting from the intake passage tends to increase the space required for accommodating the device, and to make it difficult to secure the space.

The present invention has been devised, in view of the problem of the earlier technology, to provide an air cleaner having an air cleaning function and an intake noise reducing function utilizing an inside space of the air cleaner.

According to one aspect of the present invention, an air cleaner for an internal combustion engine, comprises: an air cleaner case of a synthetic resin; and an air cleaner element disposed in the air cleaner case and arranged to partition an inside space of the air cleaner case into a dirty side space and a clean side space. The air cleaner case includes a case portion defining a tubular chamber which is formed in the air cleaner case and which extends from a first end opening into the inside space of the air cleaner case to a second end formed with a communication hole opening to an outside of the air cleaner case. The air cleaner further comprises: an elastic or flexible or resilient member which is received in the tubular chamber defined by the case portion and which includes a bellows-shaped circumferential wall extending from a base end which is open, to a forward end which is closed; a base plate covering the first end of the tubular chamber defined by the case portion and supporting the base end of the elastic member; and a communication pipe extending through the base plate and connecting a volume chamber formed inside the elastic member to the inside space of the air cleaner case. The elastic member, the case portion, the base plate and the communication pipe serve as a device disposed in the air cleaner case, for reducing intake noise.

According to another aspect of the present invention, the elastic member can vibrate by expanding and contracting in a longitudinal or axial direction of the elastic member and has a resonance frequency in a range of 30~200 Hz.

According to still another aspect of the present invention, the elastic member is disposed in the dirty side space. The case portion is formed in the dirty side space, and the volume chamber inside the elastic member is connected with the dirty side space of the air cleaner case through the communication pipe.

According to still another aspect of the present invention, the air cleaner case is formed by joining a body or first case member and a cover or second case member. The body includes an open portion in which the air cleaner element is fit. The cover is attached or fixed to the body and arranged to cover the open portion of the body (thereby to define the inside space of the air cleaner case). The tubular portion defined by the case portion extends from a bottom of the body, toward the open portion of the body, to the first end opening into the dirty side space of the air cleaner case. In the illustrated example, the bottom of the body confronts the open portion and defines the dirty side space between the bottom and the open portion.

According to still another aspect of the present invention, an intake system for an internal combustion engine, comprises an intake air duct adapted to introduce an intake air into an internal combustion engine, an outside air introduction duct to take in an outside air as the intake air, and an air cleaner connected between the intake air duct and the outside air introduction duct, and arranged to clean the intake air and to reduce intake noise by utilizing an inside space of the air cleaner. According to still another aspect of the present invention, an air cleaner comprises an air cleaner element for cleaning an intake air and an elastic or flexible or resilient member for reducing intake noise by utilizing an inside space of the air cleaner. The outside air introduction duct may be a duct including an air passage extending longitudinally in the outside air introduction duct and having no branch passage projecting from the air passage. Similarly, the intake air duct may be a duct including a branchless air passage extending longitudinally in the intake air duct and having no branch passage projecting from the air passage.

MODE(S) FOR CARRYING OUT THE INVENTION

Figure 1:
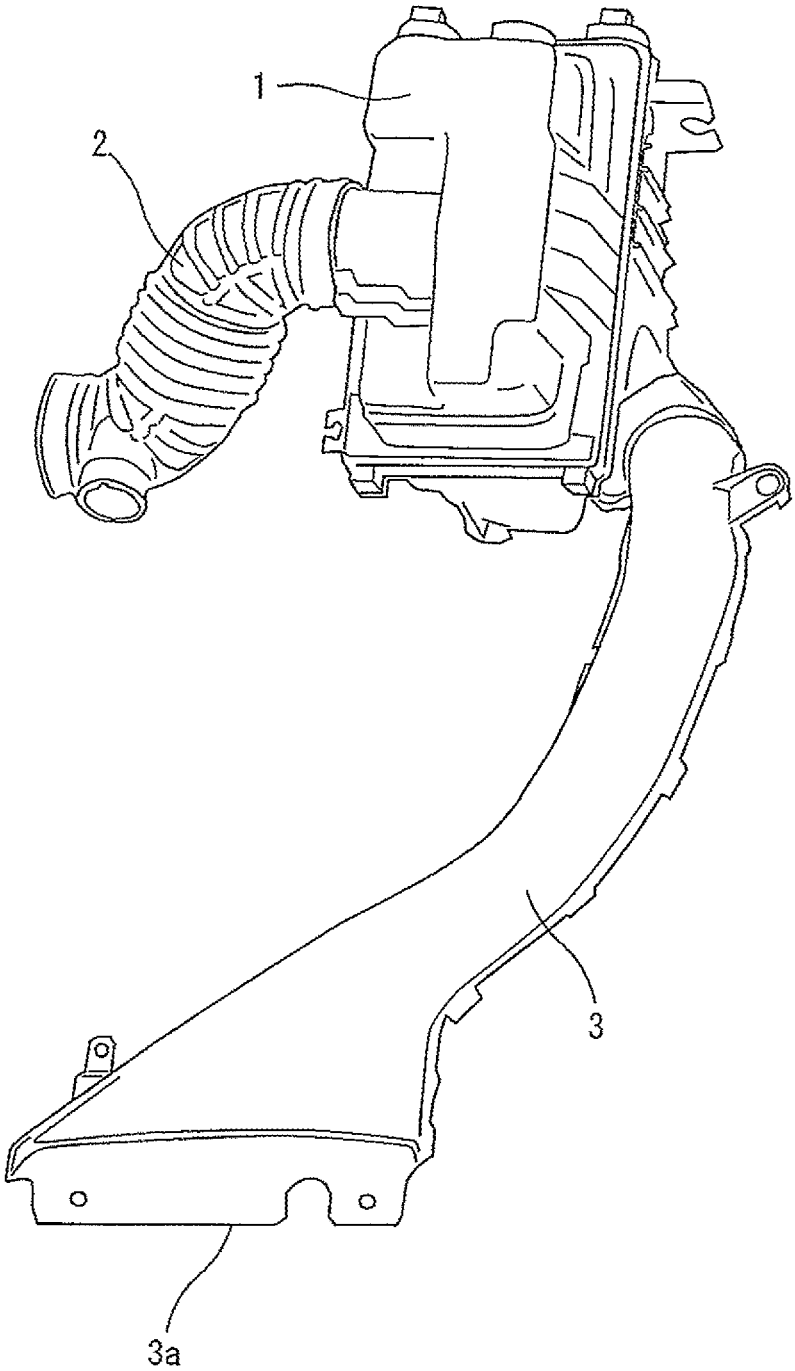
FIG. 1 is a perspective view of an intake system of an internal combustion engine, including an air cleaner according to the present invention.

FIG. 1 shows an intake system for an internal combustion engine for a motor vehicle. An air cleaner 1 according to an embodiment of the present invention is included in this intake system. An air cleaner element 5 (shown in FIG. 5) is disposed in the air cleaner 1 and arranged to divide the inside of air cleaner 1 into a clean side which is the downstream side of air cleaner element 5 and a dirty side which is the upstream side of air cleaner element 5. The clean side of air cleaner is connected to the internal combustion engine (not shown) through an intake air duct 2 which is of a flexible type in this example. The dirty side of air cleaner 1 is connected with an outside air introduction duct 3 which is a molding of hard or rigid synthetic resin, in this example. The outside air introduction duct 3 extends from the air cleaner 1 to a forward end or upstream end 3*a* which is opened as an outside air introduction inlet. The outside air is introduced from the outside air introduction inlet 3*a* through the outside air introduction duct 3 into air cleaner 1. After passage through air cleaner 1, the air is supplied to the internal combustion engine through the intake air duct 2.

Figure 2:
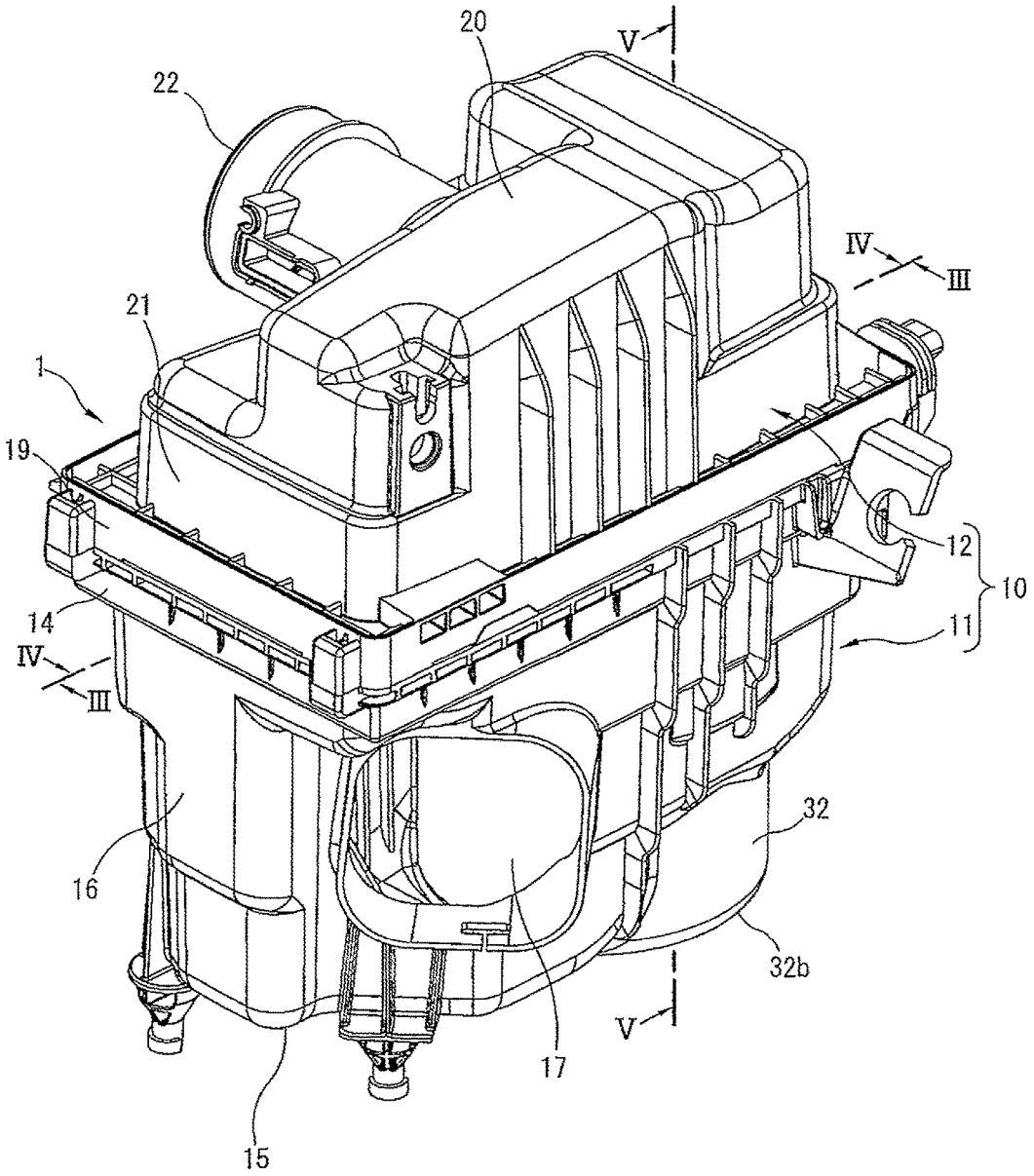
FIG. 2 is a perspective view of the air cleaner shown in FIG. 1.

Air cleaner 1 includes an air cleaner case 10 of a synthetic resin. As shown in FIGS. 2-6, the air cleaner case 10 of this example includes a body 11 and a cover 12 which are joined together. Body 11 is shaped like a container or a bucket, and has a shape similar to a rectangular parallelepiped. Body 11 includes a body-side flange 14 formed in the shape of a rectangular frame, at the upper end of body 11. Body 11 further includes a bottom wall 15 and a surrounding side wall 16 to form the shape of a container opening upwards. An intake air inlet port 17 is formed in the side wall 16 at a position near a first end of air cleaner 1 which extends longitudinally from the first end to a second or opposite end. The intake air inlet port 17 shown in FIG. 2 is shaped like a rectangular tube, and adapted to be connected with the outside air introduction duct 3 shown in FIG. 1. The body-side flange 14 defines a rectangular opening or open portion 14*a* in which the air cleaner element 5 (cf. FIG. 5) of a rectangular shape is fit. For example, the air cleaner element 5 includes a sheet of filter material such as filter paper or nonwoven fabric which is folded a plurality of times to form a plurality of pleats. Air cleaner element 5 is installed from above in the opening 14*a* detachably. Air cleaner element 5 is omitted in FIGS. 3 and 4.

The cover 12 is fixed to body 11 in a manner to cover the opening 14*a* of body 11. The cover 12 includes a cover-side flange 19 formed in the shape of a rectangular frame and adapted to abut on the body-side flange 14. The cover 12 is shaped like a container opening downwards, and the cover 12 includes an upper wall or ceiling wall 20 and a surrounding side wall 21 to form the shape of the contain opening downwards. An intake air outlet port 22 is formed in the side wall 21 of cover 12. The intake air outlet port 22 shown in FIG. 2 is shaped like a cylindrical tube, and adapted to be connected with the intake air duct 2 shown in FIG. 1. The height of cover 12 from the cover-side flange 19 to the upper wall 20 is smaller than the depth of body 11 from the body-side flange 14 to the bottom wall 15. The body-side flange 14 and cover-side flange 19 are tightened and fixed together by metallic buckle or buckles (not shown). Each of body 11 and cover 12 is an integral member formed, for example, by injection molding of the hard synthetic resin such as polypropylene resin.

Figure 5:
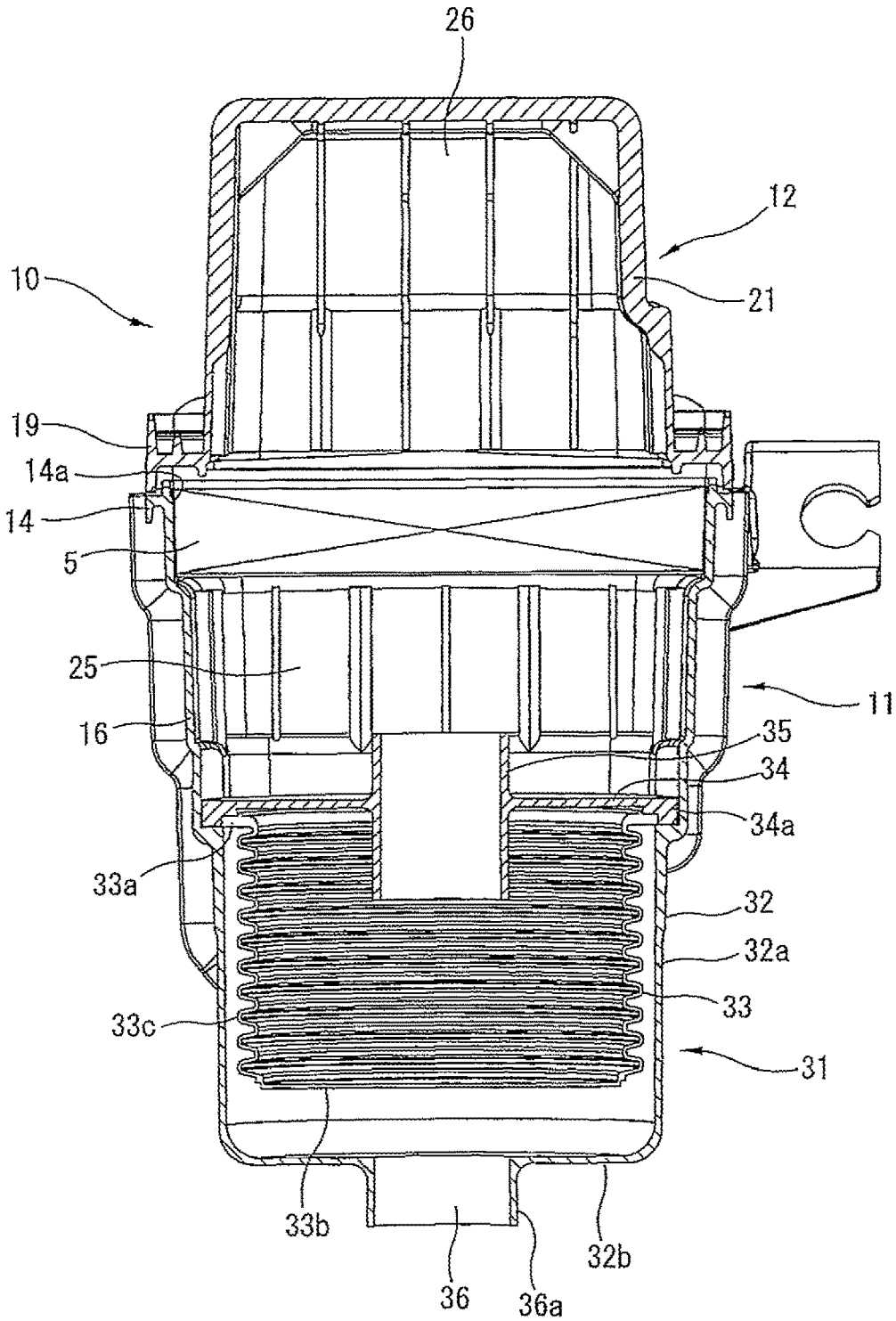
FIG. 5 is a sectional view taken across a line V-V in FIG. 2.

As shown in FIG. 5, the inside space of air cleaner case 10 made up of the body 11 and cover 12 is divided by the air cleaner element 5 disposed between the body 11 and cover 12, into a dirty side space or chamber 25 and a clean side space or chamber 26. In this example, the dirty side chamber 25 is substantially identical to the inside cavity of body 11, and the clean side chamber 26 is substantially identical to the inside cavity of cover 12. The dirty side chamber 25 is made greater than the clean side chamber 26 in order to reduce the flow speed of the intake air flowing into the air cleaner element 5.

An intake noise reducing device 31 for reducing intake pulsation noises is formed in the body 11 in this example. In this example, the intake noise reducing device 31 is disposed at a position near the second end of air cleaner 1. Body 11 extends in the longitudinal direction of air cleaner 1, from the first end (the left end as viewed in FIG. 6) of air cleaner 1 to the second end (the right end as viewed in FIG. 6). The intake air inlet port 17 is formed in the first half (left half) of body 11 between the first end (left end) and the middle of body 11 whereas the intake noise reducing device 31 is disposed in the second half (right half) of body 11 between the second end (right end) and the middle of body 11.

The intake noise reducing device 31 includes a case portion 32, an elastic member 33, a base plate 34 and a communication pipe 35, as main components. The case portion 32 for the intake noise reducing device 31 is formed integrally in body 11 so that the case portion 32 is an integral part of body 11. The elastic member 33 is a bellows-shaped member received in a tubular chamber defined by the case portion 32. The base plate 34 holds a base end of elastic member 33 and covers an open end of case portion 32. The communication pipe 35 is a hollow cylindrical member extending through the base plate 34.

The case portion 32 includes a circumferential wall 32*a* and a bottom wall portion 32*b*. The circumferential wall 32*a* of this example is a cylindrical wall standing upright from the bottom wall 15 of body 11. Specifically, the circumferential wall 32*a* extends, from the bottom wall 15, in a direction perpendicular to the rectangular open surface defined by the body-side flange 14. The bottom wall portion 32*b* of this example is a circular wall portion which is a part of the bottom wall 15 of body 11, and which closes one end of the circumferential wall 32*a*. Therefore, the case portion 32 has a hollow cylindrical shape having one end closed and the other end open, and the case portion 32 is a cup-shaped portion defining therein a tubular or cylindrical space or chamber. A communication hole 36 is formed at the center of bottom wall portion 32*b* and arranged to communicate the inside space of case portion 32 with the outside. The communication hole 36 is provided with a cylindrical portion 36*a* encircling the communication hole 36 and projecting downwards or outwards, for preventing entry of foreign objects such as rain water from the outside. The upper end of circumferential wall 32*a* is formed with a flange 32*c* expanding radially outwards.

The base plate 34 of this example is a molding of a hard synthetic resin such as polyamide resin, integral with communication pipe 35. The base plate 34 is a circular plate corresponding to the diameter of the case portion 32, and the communication pipe 35 is formed at the center of the circular base plate 34. An outer circumferential edge or brim 34*a* of base plate 34 is joined to the flange 32*c* of the upper end of case portion 32, by vibration welding or adhesive, for example.

Figure 3:
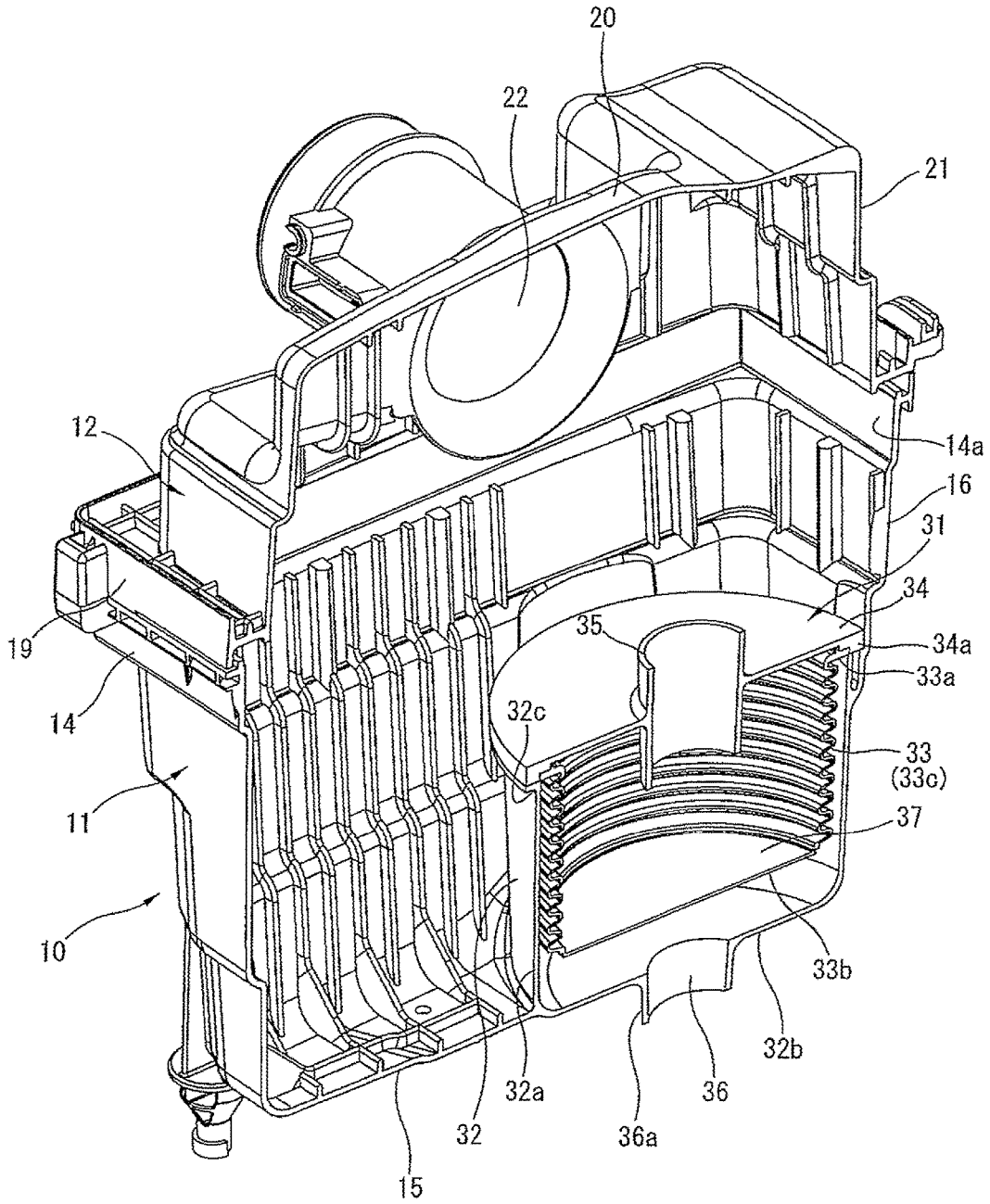
FIG. 3 is a perspective view showing a section across a line in FIG. 2.
Figure 4:
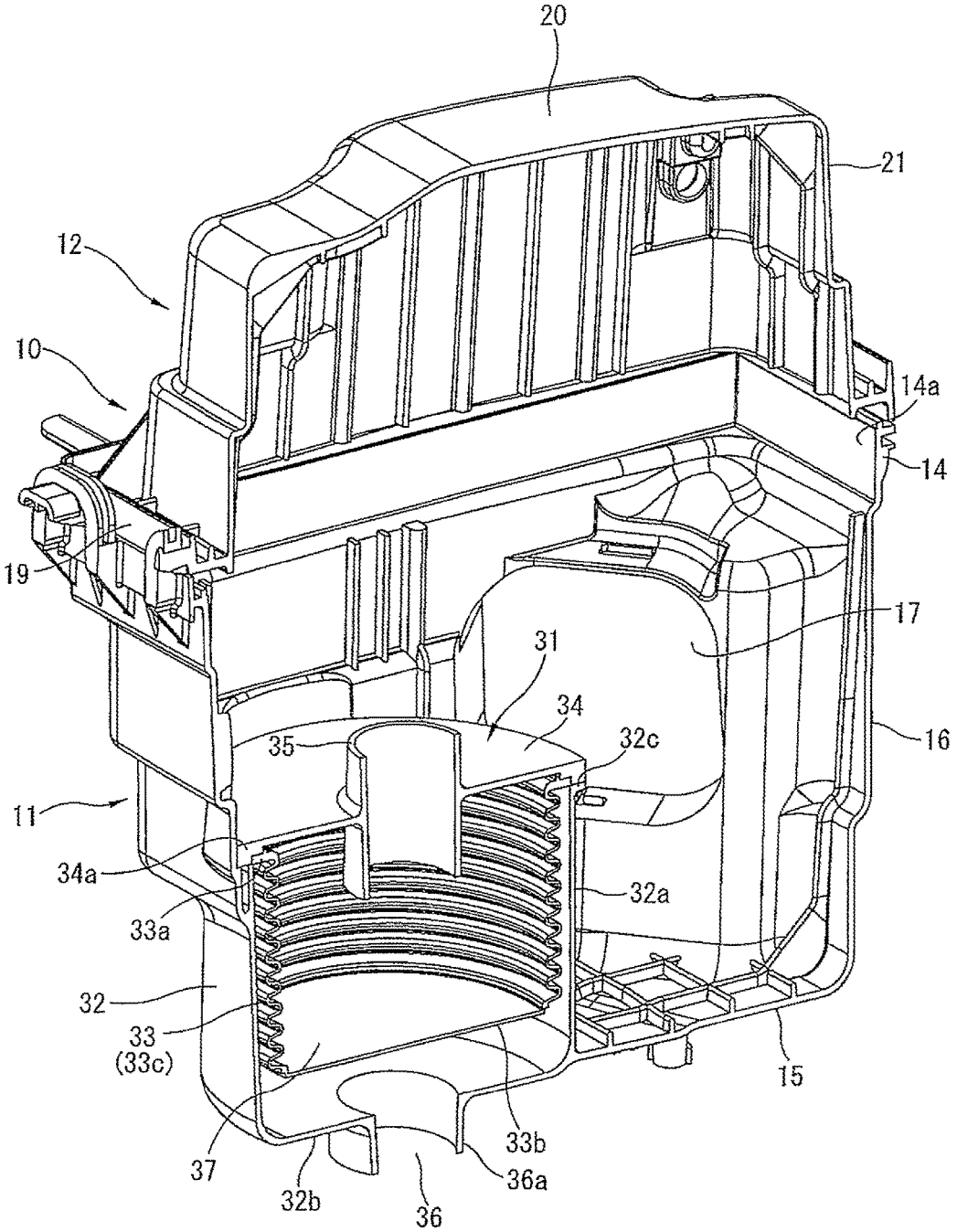
FIG. 4 is a perspective view showing a section across a line IV-IV in FIG. 2.

The elastic member 33 includes a circumferential wall 33*c* extending from a base end 33*a* to a forward end 33*b* so that the elastic member 33 is substantially cylindrical, as shown in FIG. 5 and FIGS. 3 and 4. The base end 33*a* is open whereas the forward end 33*b* is closed or sealed. The circumferential wall 33*c* is bellows-shaped or concertinaed. The elastic member 33 is an integral member formed by molding of elastic material having an appropriate elasticity, such as rubber or elastomer such as thermoplastic elastomer. The closed forward end 33*b* is in the form of a flat circular plate.

The open base end 33*a* of elastic member 33 is jointed to the inside surface of base plate 34 which is a surface defining the inside space of case portion 32, and facing toward the bottom wall portion 32*b* of case portion 32, by adhesive, for example. Thus, the base plate 34 covers the opening of base end 33*a* and thereby defines a volume chamber 37 that is the inside space of elastic member 33. The operation of joining between the elastic member 33 and base plate 34 is performed before the operation of attaching the base plate 34 to case portion 32. In other words, the elastic member 33 is fixed to base plate 34 beforehand and, by inserting the elastic member 33 into the case portion 32, the base plate 34 is placed on the flange 32*c* of case portion 32, and then joined to flange 32*c*, by vibration welding, for example.

The outside diameter of bellows-shaped circumferential wall 33*c* of elastic member 33 is slightly smaller than the inside diameter of circumferential wall 32*a* of case portion 32, as shown in FIG. 5 and FIGS. 3 and 4. Furthermore, the forward end 33*b* of elastic member 33 is spaced from the bottom wall portion 32*b* of case portion 32 by an appropriate spacing. Therefore, in the state in which the base end 33*a* is fixed by base plate 34, the forward end 33*b* of elastic member 33 can move in an expanding direction and a contracting direction freely as a free end.

Figure 6:
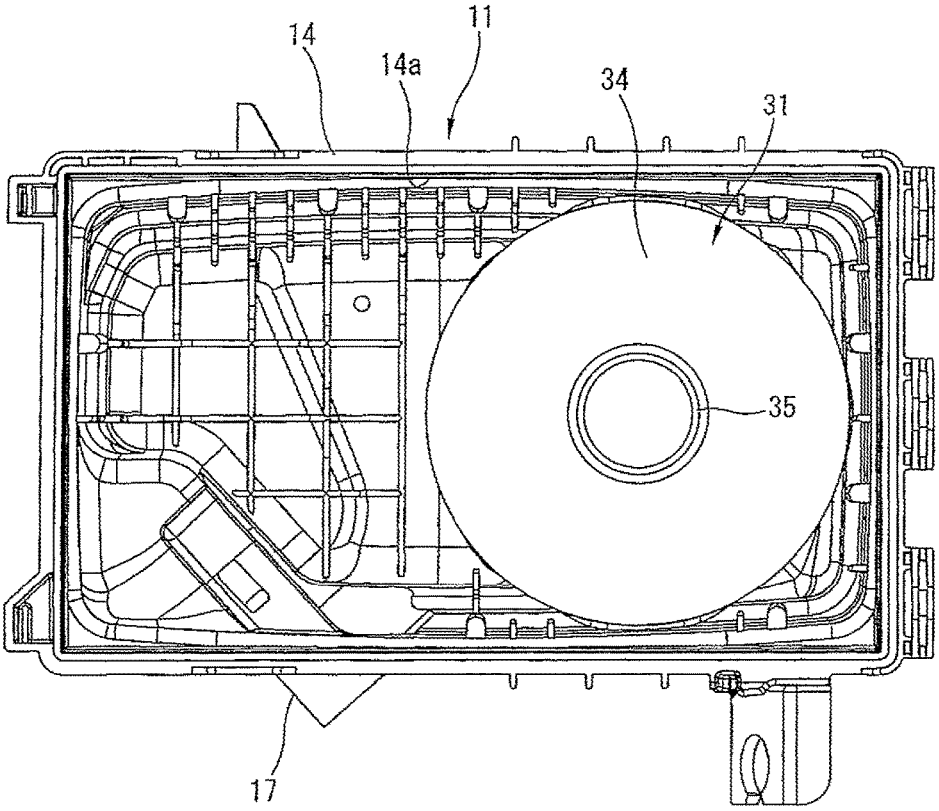
FIG. 6 is a plan view showing the inside of a body of the air cleaner with a cover removed.

As shown in FIG. 6, the external forms of circumferential wall 32*a* of case portion 32 and base plate 34 are included and surrounded by the external form of the opening 14*a* of body 11 as viewed in a plan view when projected downwards. Therefore, it is possible to form the case portion 32 integrally with body 11 at the time of the injection molding of body 11, and it is easier to fix the base plate 34 through the opening 14*a*. It is optional to fix the base plate 34 to the upper end of case portion 32 by so-called snap-fit.

In the thus-constructed intake noise reducing device 31, the volume chamber 37 closed and sealed in the elastic member 33 by base plate 34 is in fluid communication, through the communication pipe 35, with the inside space of the air cleaner case 10 (with the dirty side space 25 in the illustrated example). On the other hand, the space or interspace formed between the inside surface of case portion 32 and the outside surface of elastic member 33 is not in communication with the inside space of the air cleaner case 10, but opened to the atmosphere through the communication hole 36. Therefore, the bellows-shaped elastic member 33 is displaced or deformed in accordance with change in noise pressure in the air cleaner case 10.

The bellows-shaped elastic member 33 forms a vibration system as a kind of spring, and resonates at a predetermined resonance frequency. Therefore, in a band around the resonance frequency, the intake pulsation noise of the internal combustion engine is reduced. In this practical example of the present invention, the resonance frequency of bellows-shaped elastic member 33 in expansion and contraction in the axial direction or longitudinal direction is set in a range of 30~200 Hz, and more desirably in a range of 50~100 Hz. That is, the intake noise reducing device 31 reduces pulsation noises at relatively low frequencies with the bellows-shaped elastic member 33.

Figure 7:
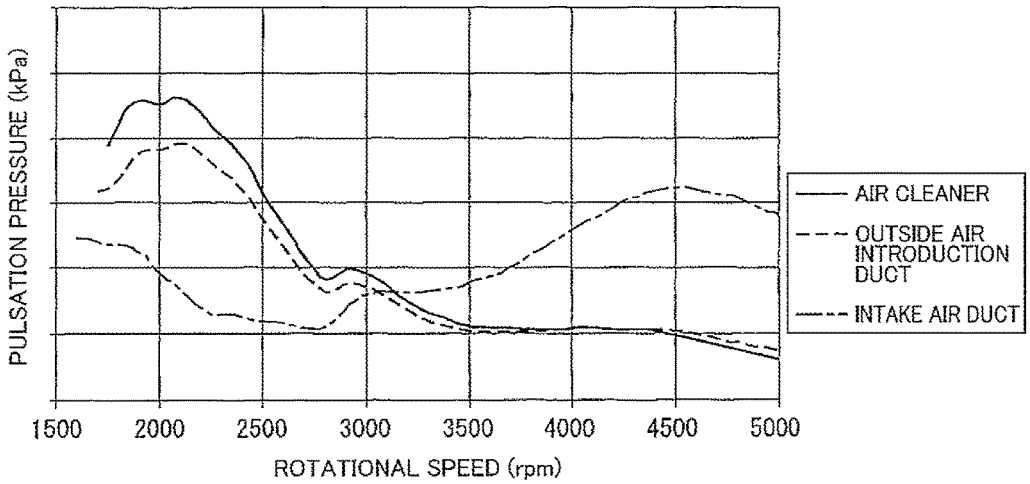
FIG. 7 is a graphic view showing pulsation pressure (secondary component) at various portions in the intake system.

FIG. 7 shows the pulsation pressure (secondary component) at different positions for comparison in the intake system including the air cleaner 1 and the intake air duct 2 and outside air introduction duct 3 connected with air cleaner 1 as shown in FIG. 1. In the example of FIG. 7, the intake noise reducing device 31 is not included in the air cleaner 1. As shown in FIG. 7, the pulsation energy is highest in the intake air duct 2 in a high engine speed region where the rotational speed of the internal combustion engine is higher. However, in a low engine speed region corresponding to the low frequency pulsation noise treated by this embodiment, the pulsation energy is highest in the air cleaner 1. Therefore, the intake noise reducing device 31 disposed inside the air cleaner 1 can reduce the intake noise effectively.

In this embodiment, the intake noise reducing device 31 is disposed in the dirty side space 25 closer to the outside air introduction duct 3. Therefore, the intake noise reducing device 31 cam reduce the intake pulsation noise leaking out through the outside air introduction duct 3 effectively at the position adjacent to the outside air introduction duct 3.

The volume chamber 37 inside the bellows-shaped elastic member 33 is always in communication with the inside space of air cleaner case 10. Therefore, the volume space 37 is part of the inside space of air cleaner case 10 practically. As mentioned before, the air cleaner 1 generally requires the inside space of a relatively large volume in the air cleaner case 10 in order to restrain the intake noises by decreasing the flow speed of the intake air flowing in rapidly through the outside air introduction duct 3, and to trap dust securely by making the flow uniform over the air cleaner element 5. According to the above-mentioned embodiment, although the inside space of the case portion 32 of intake noise reducing device 31 is separated from the inside space of air cleaner case 10 where the intake air passes, the volume chamber 37 defined inside the elastic member 33 disposed in the case portion 32 serves as part of the inside space of air cleaner case 10. Therefore, the substantial inside space of air cleaner case 10 is not decreased so much with respect to the outside size of air cleaner case 10. The increase of the outside size of air cleaner case 10 required by the installation of intake noise reducing device 31 in air cleaner case 10 is small. In other words, the intake noise reducing device 31 can be added to the intake system with no substantial increase of the outside size of air cleaner 1. Consequently, by contrast to the earlier construction in which the bellows-shaped elastic member is connected to intake air duct 2 or the outside air introduction duce 3, it is possible to decrease the space required by the entirety of the intake system, and to arrange the intake air duct 2 and outside air introduction duct 3 more freely without being restricted by the bellows-shaped elastic member.

Moreover, in the embodiment, the intake noise reducing device 31 is disposed on the bottom of the dirty side space 25 of air cleaner case 10. Therefore, even if the outside dimensions of air cleaner case 10 are to be increased, it is possible to meet the requirement by shifting the position of the bottom wall 15 of body 11 downwards without increasing the area for installing the air cleaner 1 or the area occupied by the air cleaner 1 in the plan view of the engine compartment of the vehicle. Moreover, the dirty-side space 25 of the air cleaner in general is greater than the clean-side space 26. The intake noise reducing device 31 can be installed by utilizing the greater dirty-side chamber 25.

In the above-mentioned intake noise reducing device 31, the volume chamber 37 inside the elastic member 33 and the communication pipe 35 serving as the neck tube form a Helmholtz resonant element, which functions to reduce the intake noises. This Helmholtz resonant element can perform the intake noise reduction in a frequency band higher than the noise reduction band of the low frequency pulsation noise effected, as mentioned before, by the vibration system using the bellows-shaped elastic member 33 as a spring.

According to the illustrated embodiment of the present invention, an intake apparatus for an internal combustion engine comprises an air cleaner. The intake apparatus may further comprise an outside air introduction duct connected to the air cleaner and an intake air duct to connect the air cleaner to the internal combustion engine. The air cleaner comprises an air cleaner element for air cleaning, an elastic or flexible or resilient member for intake noise reduction and an air cleaner case in which both the air cleaner element and the elastic member are disposed or encased. The air cleaner case may include a case portion defining a tubular or cylindrical chamber for receiving the elastic member. The tubular chamber is formed inside the air cleaner case and which extends from a first end opening into the inside space of the air cleaner case to a second end formed with a communication hole opening to an outside of the air cleaner case. The elastic member is received in the tubular chamber defined by the case portion and the elastic member includes a bellows-shaped circumferential or cylindrical wall extending from a base end which is open, to a forward end which is closed. The air cleaner may further comprise a base plate covering the first end of the tubular chamber defined by the case portion and supporting the base end of the elastic member, and a communication pipe or a communication passage extending through the base plate and connecting a volume chamber formed inside the elastic member to the inside space of the air cleaner case. The elastic member and the base plate (formed with the communication passage or pipe) may be in the form of a subassembly. In this case, the elastic member of the subassembly is inserted into the tubular chamber from the first end, and the base plate is placed on the case portion to close the first end and fixed to the case portion. The air cleaner case may include a side wall which includes first and second end walls confronting each other in a longitudinal direction of the air cleaner and first and second lateral walls confronting each other in a lateral direction perpendicular to the longitudinal direction (so that the air cleaner case or the body of the air cleaner case is rectangular in a plan view as shown in FIG. 6). The intake port is opened in the first lateral wall at a position near the first end wall. The tubular chamber is formed between the first and second lateral walls, and between the second end wall and the position of the inlet port. In the illustrated example, the size (or the inside diameter) of the tubular chamber is slightly smaller than the width (or distance) between the first and second lateral walls. The size (or the outside diameter) of the elastic member is slightly smaller than the size (the inside diameter) of the tubular chamber. In the illustrated example, the size (or the inside diameter) of the tubular chamber is approximately equal to a half of the length between the first and second end walls. In the illustrated example, the inlet port is opened obliquely toward the communication pipe or toward the corner between the second lateral wall and the second end wall. The outside air introduction duct may include a branchless air passage extending from an upstream end to a downstream end with no branch passage (for reducing an intake noise).

The invention claimed is:

1. An air cleaner for an internal combustion engine, the air cleaner comprising:

an air cleaner case of synthetic resin;

an air cleaner filter disposed in the air cleaner case and arranged to partition an inside space of the air cleaner case into a dirty side space and a clean side space, and an intake noise reducing device disposed in the air cleaner case, the intake noise reducing device comprising a case portion formed integrally with the air cleaner case and structured as a tube extending from a first end opening into the inside space of the air cleaner case to a second end formed with a communication hole opening to an outside of the air cleaner case, an elastic member which is received in the case portion and which includes a bellows-shaped circumferential wall extending from a base end which is open to a forward end which is closed;

a base plate covering the first end of the case portion and holding the base end of the elastic member, and a communication pipe extending through the base plate and connecting a volume chamber formed inside the elastic member to the inside space of the air cleaner case.

2. The air cleaner as claimed in claim 1, wherein a resonance frequency of the elastic member during expansion or contraction in a longitudinal direction of the elastic member is in a range of 30-200 Hz.

3. The air cleaner as claimed in claim 1, wherein the intake noise reducing device is disposed in the dirty side space.

4. The air cleaner as claimed in claim 1, wherein the air cleaner case includes a body including a rectangular open portion in which the air cleaner filter is disposed, and a cover attached to the body and arranged to cover the rectangular open portion of the body, and the case portion of the intake noise reducing device is structured as the tube extending from a bottom of the body, toward the open portion of the body, to the first end opening into the inside space of the air cleaner case.

5. The air cleaner as claimed in claim 1, wherein the air cleaner case includes an inlet port opened into the dirty side space and adapted to be connected with an outside air introduction duct to introduce outside air into the air cleaner and an outlet port opened into the clean side space and adapted to be connected with an intake air duct to convey intake air from the air cleaner to the internal combustion engine.

6. The air cleaner as claimed in claim 1, wherein the elastic member and the communication pipe form a Helmholtz resonator structured to reduce intake noise in a predetermined frequency region, and the elastic member is arranged to vibrate by expanding or contracting in the air cleaner case and to have a resonance frequency lower than the predetermined frequency region of the Helmholtz resonator.

7. The air cleaner as claimed in claim 1, wherein the elastic member is fixed to the base plate and arranged to separate the volume chamber from an interspace which is formed between the elastic member and the case portion and which is opened to the outside through the communication hole, and the communication pipe connects the volume chamber inside the elastic member with the inside space of the air cleaner case such that the volume chamber is provided as part of the inside space of the air cleaner case.

8. The air cleaner as claimed in claim 5, wherein the air cleaner case includes a bottom wall including a portion which closes the second end of the tubular chamber defined by the case portion and which is formed with the communication hole, and a side wall formed with the inlet port opening toward the communication pipe extending through the base plate and connecting the volume chamber inside the elastic member with the dirty side space.

9. The air cleaner as claimed in claim 1, wherein the elastic member is supported by the base plate in a manner to allow the forward end of the elastic member to move as a free end and to allow the elastic member to vibrate by expanding or contracting.

10. The air cleaner as claimed in claim 1, wherein the case portion includes an annular flange which surrounds the first end of the tubular chamber defined by the case portion inside the air cleaner case and which is fixed to the base plate to close the first end of the tubular chamber.

11. The air cleaner as claimed in claim 1, wherein:

the air cleaner case includes an upper wall, a bottom wall and a side wall surrounding the inside space of the air cleaner case, thereby defining the inside space which is formed between the upper wall and the bottom wall and which is divided by the air cleaner filter into the clean side space formed between the upper wall and the air cleaner filter and the dirty side space formed between the air cleaner filter and the bottom wall, and the bottom wall of the air cleaner case is formed with the communication hole extending through the bottom wall from the inside space of the air cleaner case to the outside of the air cleaner case.

* * * * *